United States Patent [19]

Johnson, Jr.

[11] Patent Number: 4,868,576

[45] Date of Patent: Sep. 19, 1989

[54] EXTENDABLE ANTENNA FOR PORTABLE CELLULAR TELEPHONES WITH GROUND RADIATOR

[75] Inventor: Robert M. Johnson, Jr., Lake Zurich, Ill.

[73] Assignee: Motorola, Inc., Schaumburg, Ill.

[21] Appl. No.: 266,423

[22] Filed: Nov. 2, 1988

[51] Int. Cl.[4] ..... H01Q 1/24

[52] U.S. Cl. ..... 343/702; 343/895; 343/900

[58] Field of Search ..... 343/700 MS, 702, 749, 343/750, 880, 895, 900

[56] References Cited

U.S. PATENT DOCUMENTS

| | | | |
|---|---|---|---|
| 4,121,218 | 10/1978 | Irwin et al. | 343/702 |
| 4,571,595 | 2/1986 | Phillips et al. | 343/702 |
| 4,700,194 | 10/1987 | Ogawa et al. | 343/700 |
| 4,723,305 | 2/1988 | Phillips et al. | 343/702 |
| 4,725,845 | 2/1988 | Phillips | 343/702 |
| 4,740,794 | 4/1988 | Phillips et al. | 343/702 |

OTHER PUBLICATIONS

"Dynatac Cellular Portable Telephones", published by and available from C & E Parts of Motorola, Inc.

*Primary Examiner*—J. Carroll
*Assistant Examiner*—Doris J. Johnson
*Attorney, Agent, or Firm*—Rolland R. Hackbart

[57] ABSTRACT

An antenna for a portable cellular telephone includes a quarter-wavelength ground radiator and a helical coil capacitively coupled to an extendable half-wavelength radiator. The extendable half-wavelength radiator includes a metallic coil molded in plastic. The ground radiator includes a serpentined transmission line on a flexible circuit board. The helical coil and ground radiator are coupled by a transmission line to a duplexer. The duplexer couples transmitter signals from a radio transmitter to the antenna and receiver signals from the antenna to a radio receiver. The antenna may be advantageously utilized in any portable radio applications where small size and immunity to hand induced radiation losses are desired.

10 Claims, 1 Drawing Sheet

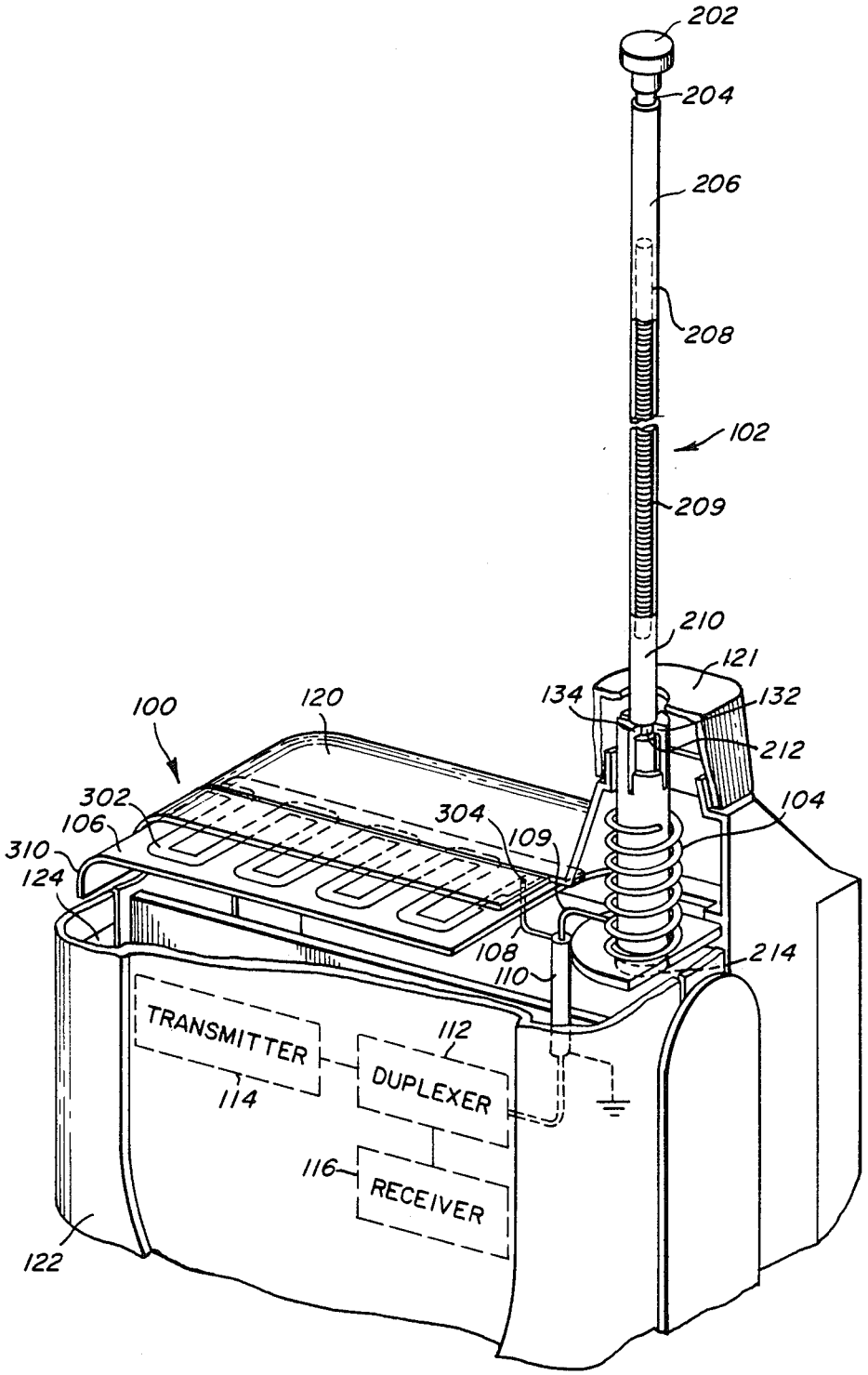
202
204
206
208
102
209
210
121
134
132
212
104
100
120
302
106
310
124
304
109
108
110
214
TRANSMITTER
114
112
DUPLEXER
116
RECEIVER
122

EXTENDABLE ANTENNA FOR PORTABLE CELLULAR TELEPHONES WITH GROUND RADIATOR

BACKGROUND OF THE INVENTION

The present invention is generally related to portable radio antennas and more particularly to an improved extendable antenna for portable cellular telephones.

Prior art antennas which mount to a portable radio and transmit and receive radio frequency signals typically use a one-half wavelength parasitic element. Such prior art radiating elements are too long to be of practical use in portable radios. This problem has bee solved in part by using a telescoping metallic radiating element, such as that shown and described in U.S. Pat. No. 4,121,218, incorporated herein by reference. However, such telescoping antennas are not only rather long but also difficult for the user to fully extend for proper operation and are easily bent and broken.

Furthermore, since styling requires an antenna to be in proper proportion to the portable radio housing, a full length half-wavelength parasitic element will, for asthetic reasons, typically not look good. For each size of radio housing, there will only be one half-wavelength parasitic element physical length which is in proper proportion to the housing Another problem experienced by prior art antennas is the radiation degradation experienced when the portable radio is held and used by the operator. Prior art antennas typically use the metallic housing of the portable radio as a ground radiator Radiation degradation is typically experienced with prior art antennas when the operator places his hand around the metallic housing, thereby causing degradation in the radiation efficiency of the ground radiator.

Degradation in the radiation efficiency of the ground radiator has been minimized in at least one prior art portable cellular telephone by use of a quarter-wavelength ground radiator which is located at the end of the housing adjacent to a quarter-wavelength radiator. This quarter-wavelength ground radiator is a wire radiator which is a full quarter-wavelength long. Not only is the quarter-wavelength ground radiator rather long, but the quarter-wavelength radiator of this prior art cellular portable telephone suffers from all of the problems and shortcomings set forth hereinabove. For the foregoing reasons, there is a need for an improved antenna for portable radios which is includes a small and efficient radiator which is not degraded when held and used by the operator.

Objects of the Invention

Accordingly, it is an object of the present invention to provide an improved extendable antenna system for portable cellular telephones which is shorter in length than a traditional half-wavelength antenna, thereby achieving an antenna which can be retracted into the portable cellular telephone housing without using telescoping elements.

It is also the object of the present invention to provide an improved extendable antenna system for portable cellular telephones which achieves minimized radiation efficiency losses when the portable cellular telephone is held and used by the operator.

BRIEF DESCRIPTION OF THE DRAWINGS

The FIGURE is a partial cross sectional view of a portable cellular telephone including an extendable antenna system embodying the present invention.

DESCRIPTION OF THE PREFERRED EMBODIMENT

In the FIGURE, there is illustrated a partial cross sectional view of a portable cellular telephone 100 including an extendable antenna system embodying the present invention. The extendable antenna system includes an extendable half-wavelength radiator 102, a helical coil 104, a quarter-wavelength radiator 106, a duplexer 112, a radio transmitter 114, and a radio receiver 116. According to a feature of the present invention, the elements 102, 104, 106, 112, 114 and 116 of the extendable antenna system are mounted inside the housing 121–122 of portable cellular telephone 100. The extendable antenna system concept of the present invention may be advantageously utilized on any electronic product requiring the transmission and/or reception of radio frequency signals.

In the preferred embodiment, the antenna system of the present invention is used in a cellular telephone for transmitting and receiving radio frequency signals having frequencies between 824–849 mHz and 869–894 mHz. During use, the operator typically holds cellular telephone 100 in his hand once dialing of the desired telephone number is completed or to answer an incoming telephone call. Cellular telephone 100 may be any commercially available cellular telephone, such as, for example, the Motorola portable cellular telephone shown and described in detail in Motorola instruction manual no. 68P81046E60, entitled "DYNATAC Cellular Portable Telephone," published by and available from C & E Parts of Motorola, Inc., 1313 East Algonquin Road, Schaumburg, Ill., 60196, U.S.A.

Referring to the FIGURE, radiator 102 includes two detents 204 and 212 which engage tangs 132 and 134 of antenna housing 121 when retracted and extended, respectively. Tangs 132 and 134 snap into detents 204 and 212 providing the operator with tactile feedback indicating that radiator 102 is fully retracted or extended, respectively. Radiator 102 slides into and out of antenna housing 121, sliding through helical coil 104.

Referring to the FIGURE, radiator 102 is illustrated in more detail. Radiator 102 includes protective top end cap 202, top portion 206 with detent 204, middle portion 208 with coil 209, bottom portion 210 with detent 212, and bottom end cap 214. Radiator 102 is preferably comprised of flexible plastic, such as "Delryn," and coil 209 is preferably comprised of silver plated beryllium-copper wire having a diameter of 13 mils. Therefore, according to a feature of the present invention, radiator 102 acts as a resilient spring. Coil 209 is molded inside the flexible plastic to produce radiator 102 having an outside diameter of 100 mils. Since coil 209 is helically wound, its electrical length is one-half wavelength while its physical length is much less than one-half wavelength, and it acts as a spring. In the preferred embodiment, coil 209 is comprised of 91 turns and has an outside diameter of 53 mils. As a result, coil 209 has a physical length of 2.6 inches and an electrical length of one-half wavelength at 850 mHz. This is equivalent to the electrical length of a full size one-half wavelength of physical length equal to 7 inches. The overall length of radiator 102 is 5 inches, where top portion 206 is 1.2 inches, center portion 208 is 2.6 inches, and bottom portion 210 is 1.2 inches.

Referring to the FIGURE, helical coil 214 capacitively couples to radiator 102 for transmitting and receiving radio signals. In the preferred embodiment, coil 214 is comprised of 6 turns and has an outside diameter of 280 mils. As a result, coil 214 has a physical length of 0.7 inches and an electrical length of one-quarter wavelength at 850 mHz. This is equivalent to the electrical length of a full size one-quarter wavelength of physical length equal to 3.5 inches. Radio signals are coupled to and from helical coil 104 by means of connector 109 coupled to the bottom end of coil 104 and to the center conductor of transmission line 110. In the preferred embodiment, transmission line 110 is implemented by a stripline transmission line on a printed circuit board. Transmission line 110 is coupled to duplexer 112, which couples- transmitter signals from radio transmitter 114 to coil 104 and receiver signals from coil 104 to radio receiver 116. Radio transmitter 114 and receiver 116 are inside bottom housing 122 and surrounded by ground metallization 124. In the preferred embodiment, top, antenna and bottom housings 120–122 are comprised of plastic and ground metallization 124 is produced by conductively coating the inside of bottom housing 122.

When in use, bottom housing 122 is substantially enclosed by the operator's hand and further shielded by the operator's head and associated portable telephone battery, resulting in a substantial reduction in the radiation efficiency in prior art antennas, such as those shown in the aforementioned U.S. patent no. 4,121,218.

To substantially minimize this radiation efficiency problem, the antenna system of the present invention includes ground radiator 106 for diverting the antenna currents from bottom housing ground metallization 124, thereby substantially reducing the operator induced radiation efficiency loss. Ground radiator 106 has an electrical length of a quarter wavelength and is positioned in top housing 120 of portable telephone 100 so that the operator's hand will not enclose it. Ground radiator 106 decouples the radio signal current from bottom housing ground metallization 124 since radiator 106 appears to be a lower impedance than bottom housing 122 does at the feed point. The design of such ground radiators is described in further detail in U.S. Pat. No. 4,700,194, incorporated herein by reference.

Referring to the FIGURE, there is illustrated the preferred embodiment of ground radiator 106. Radiator 106 includes a flexible circuit board 310 or other suitable substrate on which a serpentined transmission line 302 is placed. Since transmission line 302 is serpentined, its electrical length is a quarter wavelength while its physical length is less than a quarter wavelength. Feed point 304 of transmission line 302 is coupled by connector 108 to the grounded shield of transmission line 110. Circuit board 310 is preferably comprised of a flexible material such as "Kapton" and may be bonded to the surface of top housing 120 by glue or other suitable adhesives.

In summary, a unique extendable antenna for portable cellular telephones is shorter in length than a traditional half-wavelength antenna, thereby achieving an antenna which can be retracted into the portable cellular telephone housing without using telescoping elements. The improved extendable antenna also achieves minimized radiation efficiency losses when the cellular telephone is held and used by the operator. By utilizing the present invention, both small size and minimized radiation losses have been integrated into a portable antenna system which maintains excellent radiation efficiency when handheld. The antenna system of the present invention may be advantageously utilized in any portable radio applications where small size and immunity to hand induced radiation losses are desired.

I claim:

1. An extendable antenna system for a portable radio transceiver enclosed in housing means having top and bottom portions, the bottom portion of the housing means having a conductive surface; said extendable antenna system comprising:

helical antenna means disposed in the top portion of the housing means and including a helical winding having a first end coupled to the transceiver and having a second end;

extendable half-wavelength radiating means having non-conductive top and bottom portions and a conductive center portion and extending through said helical winding, the conductive portion of aid extendable half-wavelength radiating means being capacitively coupled to the second end of said helical winding when extended from the top portion of the housing means and being substantially decoupled therefrom when retracted into the bottom portion of the housing means; and quarter-wavelength radiating means disposed in the top portion of the housing means substantially at right angles with respect to said helical antenna means and couples to the transceiver ground and the conductive surface of the housing means.

2. The extendable antenna system according to claim 1, wherein the conductive center portion of said extendable half-wavelength radiating means is comprised of a coiled spring having a predetermined number of coils.

3. The extendable antenna system according to claim 2, wherein said top and bottom portions of said extendable half-wavelength radiating means are plastic and said coiled spring of said half-wavelength radiating means is enclosed in plastic.

4. The extendable antenna system according to claim 1, wherein said quarter-wavelength radiating means is comprised of a metallic conductor bonded to a flexible substrate means.

5. The extendable antenna system according to claim 4, wherein said metallic conductor of said quarter-wavelength radiating means has a serpentined pattern.

6. A portable radio comprising:

transmitter means;

receiver means;

transmission line means having first and second ends;

duplexing means for coupling said transmitter means and said receiver means to the first end of said transmission line means;

housing means having top and bottom portions, the bottom portion of said housing means having a conductive surface for enclosing said transmitter means, said receiver means and said duplexing means; and an extendable antenna system comprising:

helical antenna means disposed in the top portion of said housing means and including a helical winding having first and second ends, the first end of said helical winding being coupled to the second end of said transmission line means;

extendable half-wavelength radiating means having non-conductive top and bottom portions and a conductive center portion and extending through said helical winding, the conductive portion of said extendable half-wavelength radiating means being capacitively coupled to the second end of said helical winding when extended from the portion of said housing means and being substantially decoupled therefrom when retracted into the bottom portion of said housing means; and quarter-wavelength radiating means disposed in the top portion of said housing means substantially at right angles with respect to said helical antenna means and coupled to the transceiver ground and the conductive surface of said housing means.

7. The portable radio according to claim 6, wherein the conductive center portion of said extendable half-wavelength radiating means is comprised of a coiled spring having a predetermined number of coils.

8. The portable radio according to claim 7, wherein said top and bottom portions of said extendable half-wavelength radiating means are plastic and said coiled spring of said half wavelength radiating means is enclosed in plastic.

9. The portable radio according to claim 6, wherein said quarter-wavelength radiating means is comprised of a metallic conductor bonded to a flexible substrate means.

10. The portable radio according to claim 9, wherein said metallic conductor of said quarter-wavelength radiating means has a serpentined pattern.

* * * * *